US007641452B2

(12) United States Patent
Liao

(10) Patent No.: US 7,641,452 B2
(45) Date of Patent: Jan. 5, 2010

(54) MANUALLY OPERATED VACUUM PUMP AND REFILL DEVICE

(75) Inventor: Lin Po Liao, Taiching (TW)

(73) Assignee: Lih Yann Industrial Co., Ltd., Taichung (TW)

( * ) Notice: Subject to any disclaimer, the term of this patent is extended or adjusted under 35 U.S.C. 154(b) by 246 days.

(21) Appl. No.: 11/653,335

(22) Filed: Jan. 16, 2007

(65) Prior Publication Data

US 2008/0170949 A1 Jul. 17, 2008

(51) Int. Cl.

| | |
|---|---|
| ***F04B 23/00*** | (2006.01) |
| ***F04B 23/02*** | (2006.01) |
| ***F04B 41/00*** | (2006.01) |
| ***F04B 41/02*** | (2006.01) |
| ***F04B 53/00*** | (2006.01) |
| ***F04B 53/10*** | (2006.01) |
| ***F04F 3/00*** | (2006.01) |
| ***B67C 3/16*** | (2006.01) |

(52) U.S. Cl. ..... 417/440; 417/555.1; 417/148; 137/205

(58) Field of Classification Search ..... 417/53, 417/118, 148, 554, 555.1; 137/205
See application file for complete search history.

(56) References Cited

U.S. PATENT DOCUMENTS

| | | | | | |
|---|---|---|---|---|---|
| 2,527,849 | A | * | 10/1950 | Ranney | 137/205 |
| 3,280,858 | A | * | 10/1966 | Paulson | 141/42 |
| 3,680,361 | A | * | 8/1972 | Taylor | 73/49.2 |
| 4,782,689 | A | * | 11/1988 | DeRome | 73/49.2 |
| 4,888,980 | A | * | 12/1989 | DeRome | 73/49.2 |
| 5,069,062 | A | * | 12/1991 | Malecek et al. | 73/49.7 |
| 5,318,700 | A | * | 6/1994 | Dixon et al. | 210/712 |
| 5,511,590 | A | * | 4/1996 | Turcotte et al. | 141/7 |
| 5,540,557 | A | * | 7/1996 | Carson | 417/53 |
| 5,649,574 | A | * | 7/1997 | Turcotte et al. | 141/67 |
| 5,673,733 | A | * | 10/1997 | Turcotte et al. | 141/65 |
| 5,853,068 | A | * | 12/1998 | Dixon et al. | 184/1.5 |
| 6,029,720 | A | * | 2/2000 | Swinford | 141/385 |
| 6,152,193 | A | * | 11/2000 | Klamm | 141/98 |
| 6,234,215 | B1 | * | 5/2001 | Klamm | 141/1 |
| 6,435,848 | B1 | * | 8/2002 | Minami et al. | 417/440 |
| 6,584,994 | B2 | * | 7/2003 | Knowles et al. | 137/14 |
| 6,588,445 | B2 | * | 7/2003 | Knowles et al. | 137/205 |
| 6,612,327 | B2 | * | 9/2003 | Knowles et al. | 137/205 |
| 6,742,535 | B1 | * | 6/2004 | Knowles et al. | 137/14 |
| 6,883,533 | B2 | * | 4/2005 | Knowles et al. | 137/14 |
| 6,883,535 | B1 | * | 4/2005 | Cromwell et al. | 137/148 |
| 2004/0089371 | A1 | * | 5/2004 | Few | 141/98 |

* cited by examiner

*Primary Examiner*—Devon C Kramer
*Assistant Examiner*—Bryan Lettman
(74) *Attorney, Agent, or Firm*—Muncy, Geissler, Olds & Lowe, PLLC

(57) ABSTRACT

A manually operated vacuum pump and refill device includes a body on top with a vacuum pump attached, and a lower portion of the body is arranged with an elastic adapter. The adapter has a central channel in communication with the body. The body includes an inlet in which a water supply is connected. A control valve is arranged on the water supply before it reaches to the body. The vacuum pump is further arranged with a check valve with respect to the body. The body is also arranged with a check valve securely positioned with a C-clip. The check valve is provided with a float moveably within a chamber thereof.

12 Claims, 8 Drawing Sheets

MANUALLY OPERATED VACUUM PUMP AND REFILL DEVICE

BACKGROUND OF THE INVENTION

1. Field of the Invention

The present invention relates to a manually operated vacuum pump, and more particularly to a manually operated vacuum pump and refill device in which liquid can be rapidly refilled after a radiator is vacuumed.

2. Description of Prior Art

A radiator of an automobile plays a great role in dissipating heat generated by an engine. The radiator generally is a closed heat-exchange system and by cycling the water contained therein, heat generated from the engine can be dissipated. However, after a period of time, the cooling water will vaporize and need to be refilled from time to time. Ideally, it is preferable that there is no air trapped within the closed-system since air trapped inside the radiator will negatively influence the heat dissipating rate. As a result, it is preferable to vacuum the radiator first such that no air is trapped therein, and then refill the cooling water. By this arrangement, this will best provide an ideal closed-loop heat-exchange system.

Therefore a need exists to provide a device such that the radiator can be quickly vacuumed and then simultaneously refilled the with water without mixing in any air.

SUMMARY OF THE INVENTION

It is an object to provide a device such that a radiator can be easily and quickly vacuumed.

In order to achieve an object set forth, a manually operated vacuum pump and refill device in accordance with the present invention includes a body on top with a vacuum pump attached, and a lower portion of the body is arranged with an elastic adapter. The adapter has a central channel in communication with the body. The body includes an inlet in which a water supply is connected. A control valve is arranged on the water supply before it reaches to the body. The vacuum pump is further arranged with a first check valve with respect to the body. The body is also arranged with a second check valve securely positioned with a C-clip. The second check valve is provided with a moveable float within a chamber thereof.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF PREFERRED EMBODIMENTS

Figure 1:
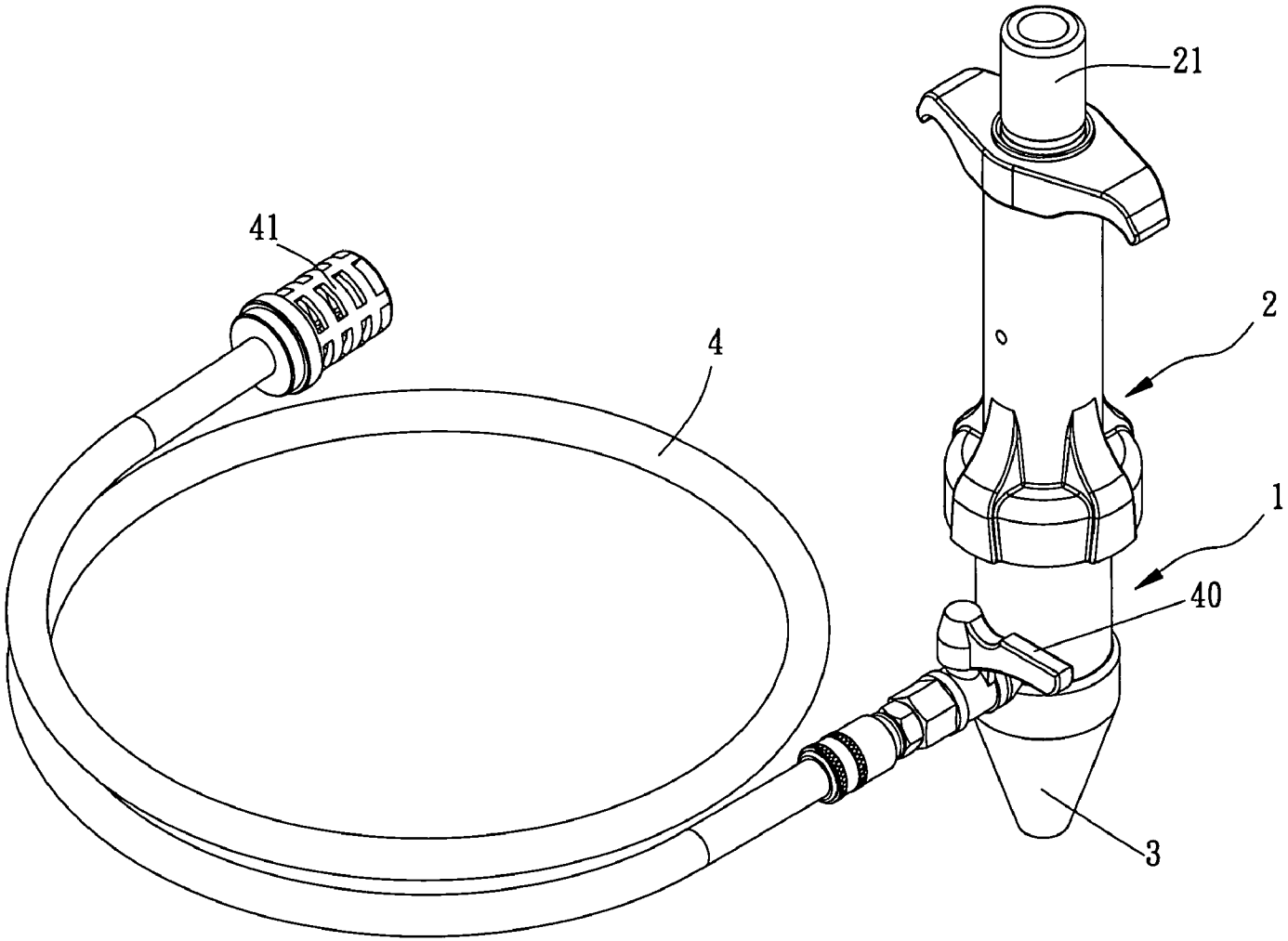
FIG. 1 is a perspective view of the device made in accordance with the present invention.
Figure 2:
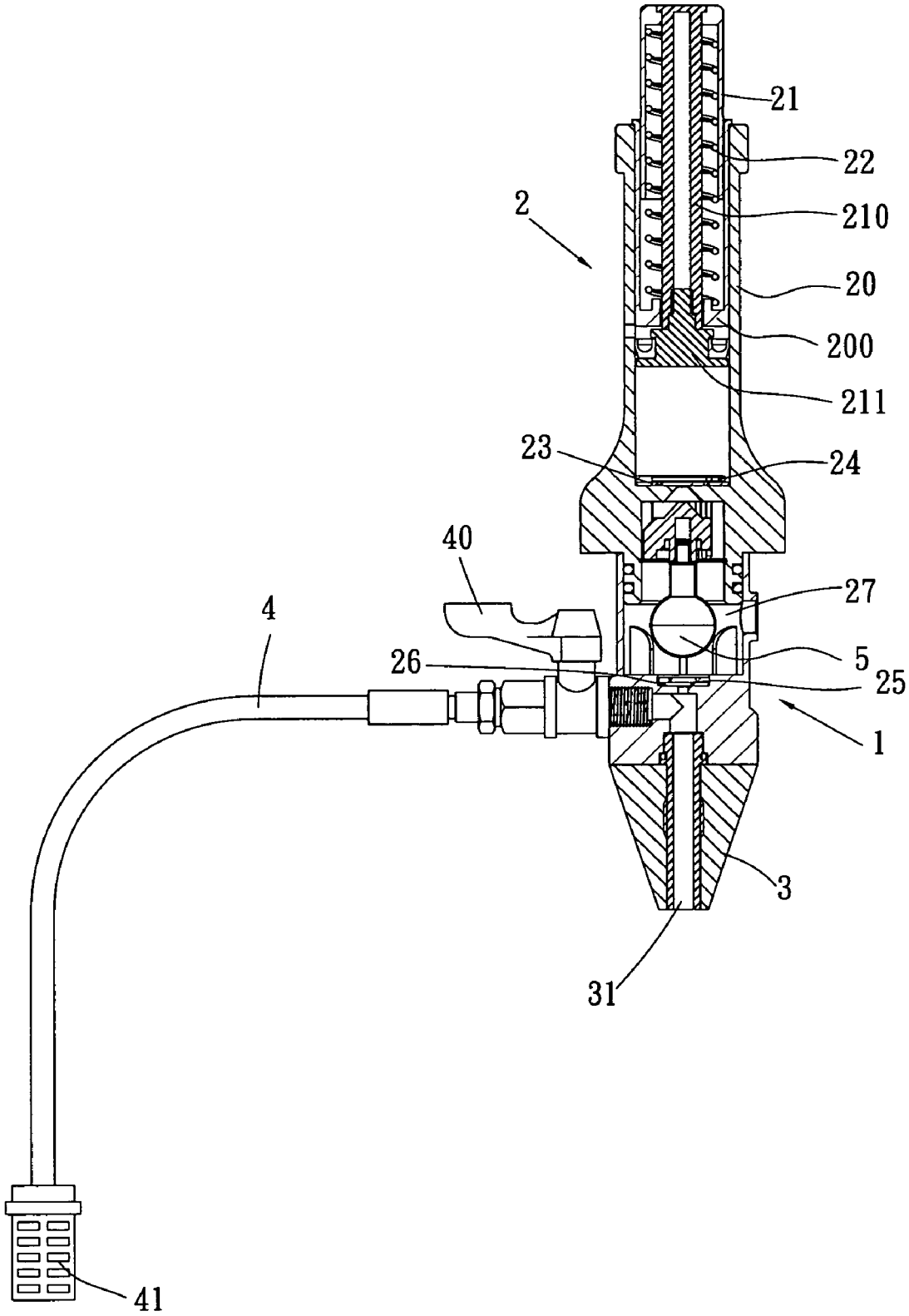
FIG. 2 is a cross sectional view of the device shown in FIG. 1.

Referring to FIG. 1, a perspective view of a manually operated vacuum pump and refill device made in accordance with the present invention; while FIG. 2 further discloses an internal structure of the device. The device includes a body 1 on top there is a vacuum pump 2 attached, and a lower portion of the body 1 is attached with an elastic adapter 3. The adapter 3 has a central channel 31 in communication with the body 1. The body 1 further includes an inlet in which a water supply 4 is connected. A control valve 40 is arranged on the water supply 4 before it reaches to the body 1. A filter 41 is arranged in the water supply 4 at an end thereof.

The vacuum pump 2 includes an outer pipe 20 with a stopper 200 located at a Certain depth from a top of the outer pipe 20. A piston 21 is assembled within the outer pipe 20 and enveloped with a coil spring 22 assembled along a stud 210. An end of the coil spring 22 abuts against the stopper 200. The stud 210 extends through the stopper 200 and the piston 21 is securely attached to an end of the stud 210. The vacuum pump 2 is further arranged with a first check valve 23 with respect to the body 1, and the first check valve 23 is securely positioned by a C-clip 24. The body 1 is also arranged with a second check valve 25 securely positioned with a C-clip 26. The second check valve 25 is provided with a movable float 5 within a chamber 27 thereof.

Figure 3:
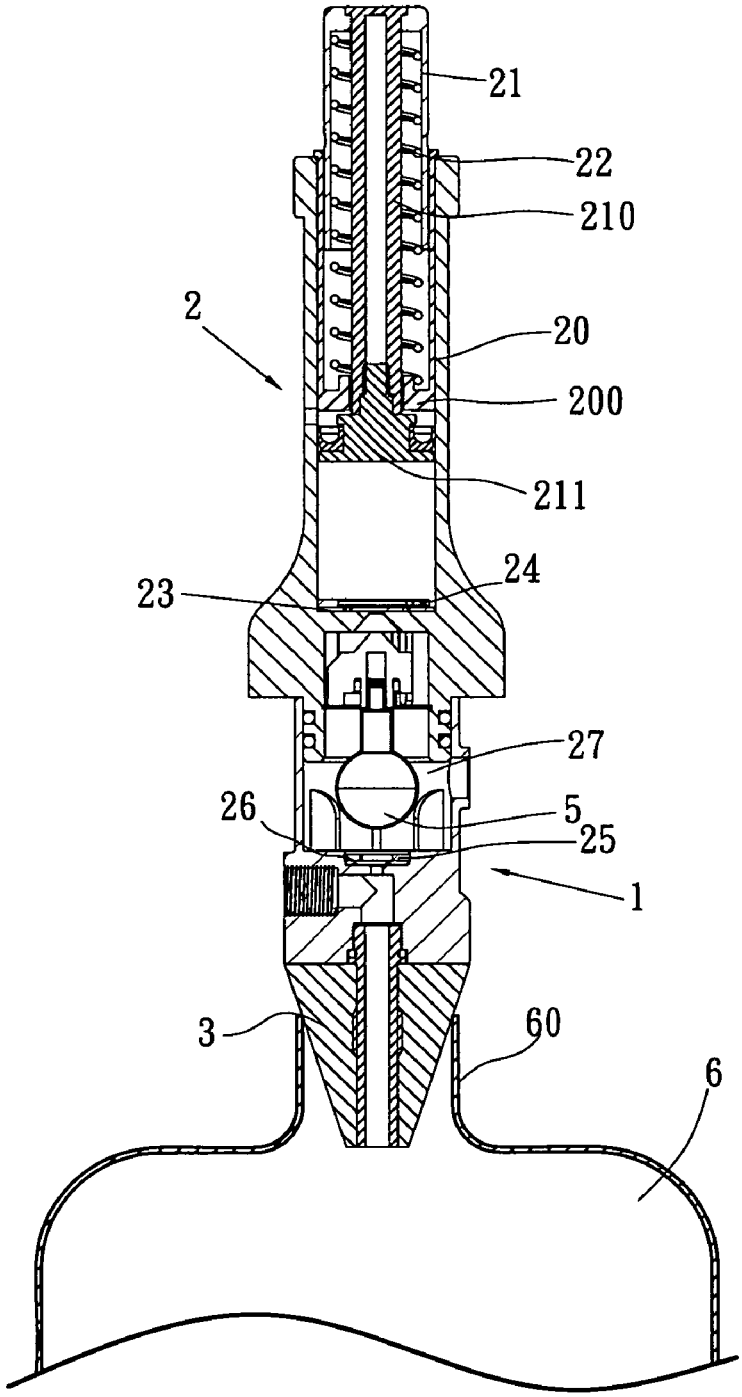
FIG. 3 is an illustration in which the device is attached to a radiator.
Figure 4:
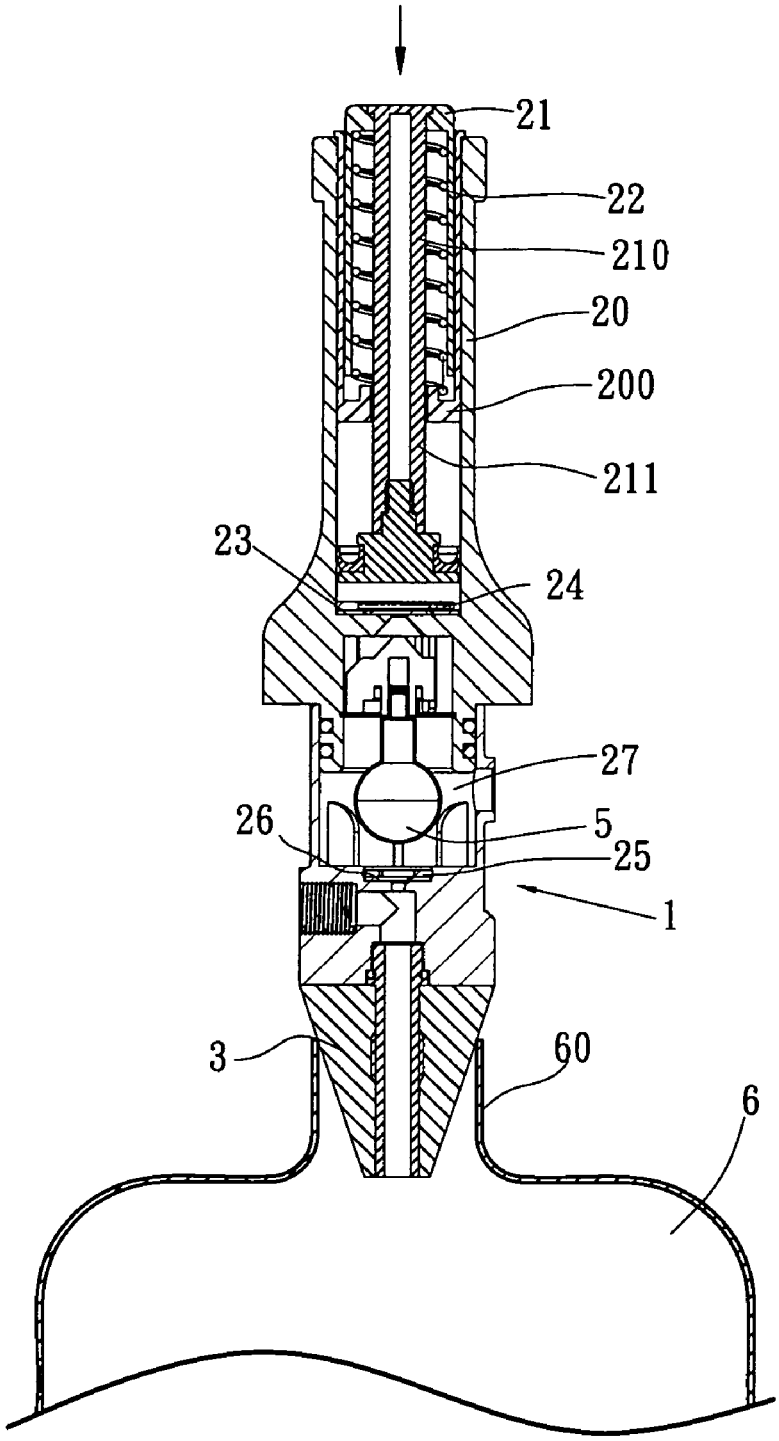
FIG. 4 is still an illustration following the situation shown in FIG. 3.

Referring to FIG. 3, the device in accordance with the present invention is seated into an opening 60 of a radiator 6. Since the adapter 3 is made from elastic material and can be easily and air-tightly fitted into the opening 60 of the radiator 6.

After the adapter 3 is well seated, the controlling valve 40 is switched to "closed" position such that the radiator 6 becomes an isolated and closed environment. Then, the vacuum pump 2 can be manually operated such that after each downward and upward cycle, air trapped within the radiator 6 can be sucked out of the radiator 6 and then into the body 1. Afterward, the air is drained out from peripheral of the piston 211. After several cycles of the pump 2, the air trapped within the radiator 6 can be completely sucked out, and the radiator 6 will have a vacuum.

Figure 5:
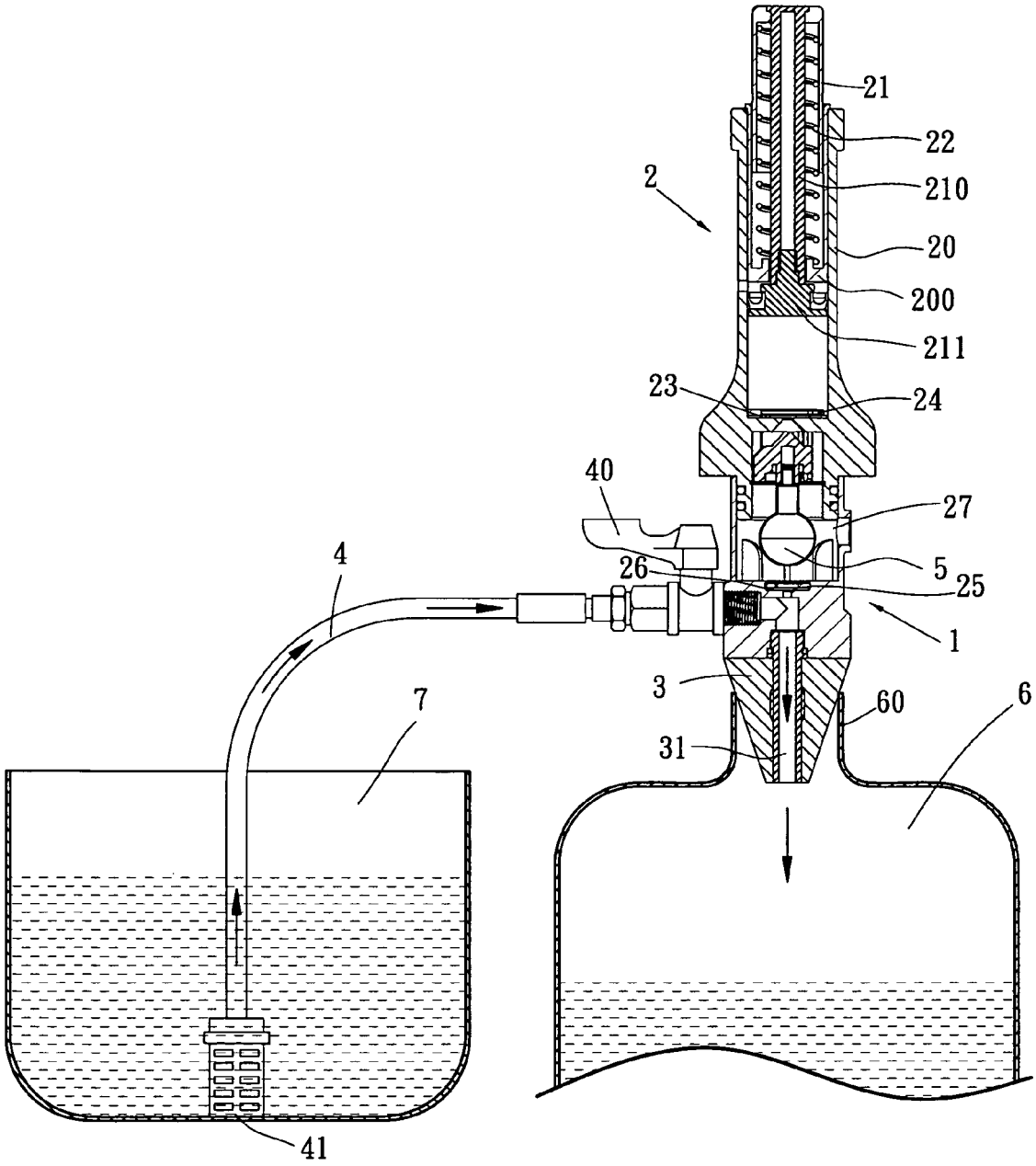
FIG. 5 is still an illustration in which liquid is refilled into the radiator.
Figure 6:
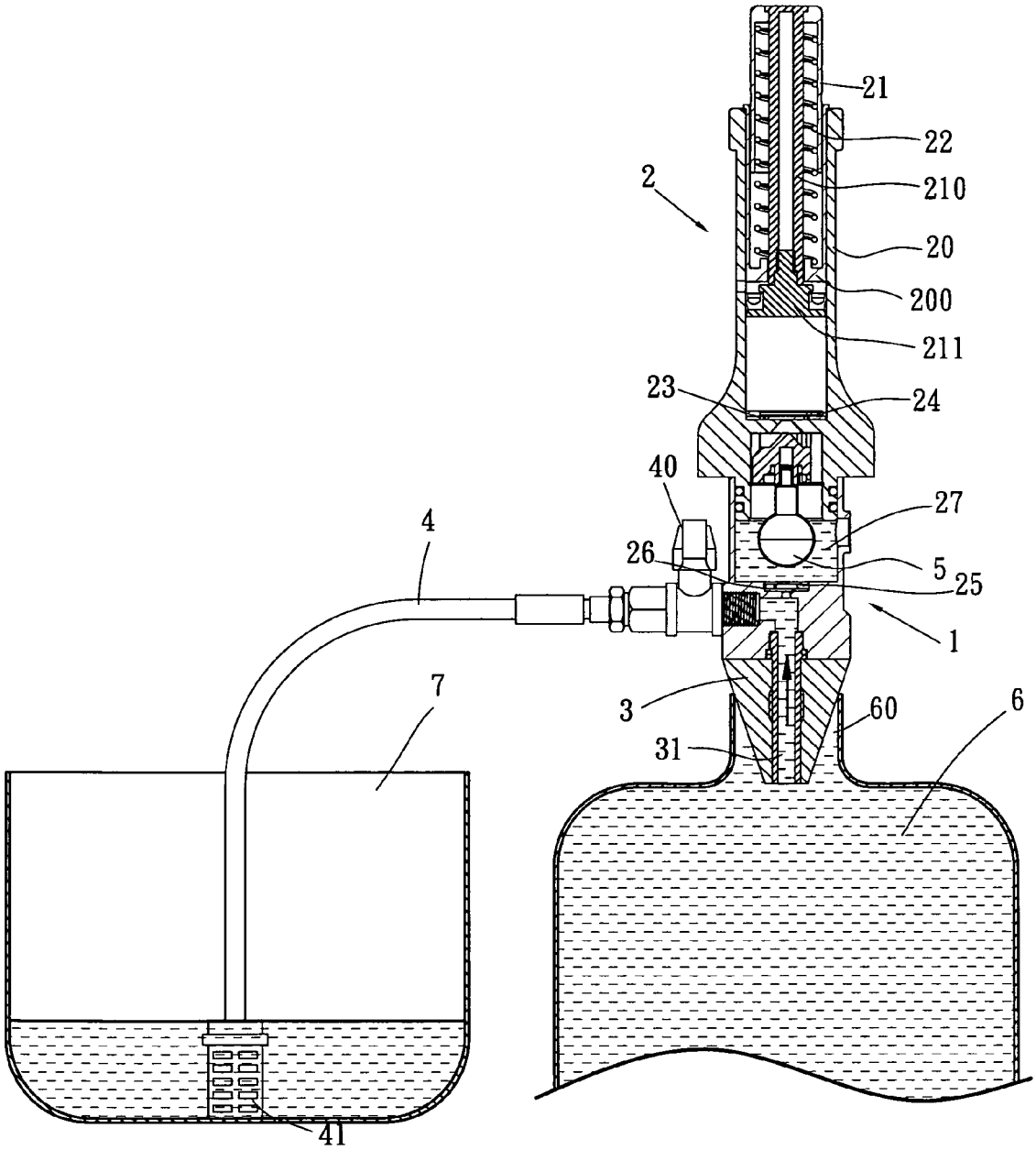
FIG. 6 is a schematic view showing a float in the device is working after the liquid reach a certain level.

Referring to FIG. 5, when the radiator 6 in vacuum, the water can then be easily filled into the radiator 6. The water supply 4 will then be immersed into a water resource 7 with its end having filter 41. Once the controlling valve 40 is switched to "opened" position, since the radiator 6 is in vacuum, the water within the resource 7 will naturally flow into the radiator 6 from atmosphere pressure differential. Since the radiator 6 in vacuum, no air within the radiator 6 will be mixed into the water.

In order to prevent the water from overflowing into the body 1, the float 5 will plug into a conduit in communication wit the pump 2 when the water overflows into the chamber 27, thereby blocking the water from flowing into the pump 2.

Figure 7:
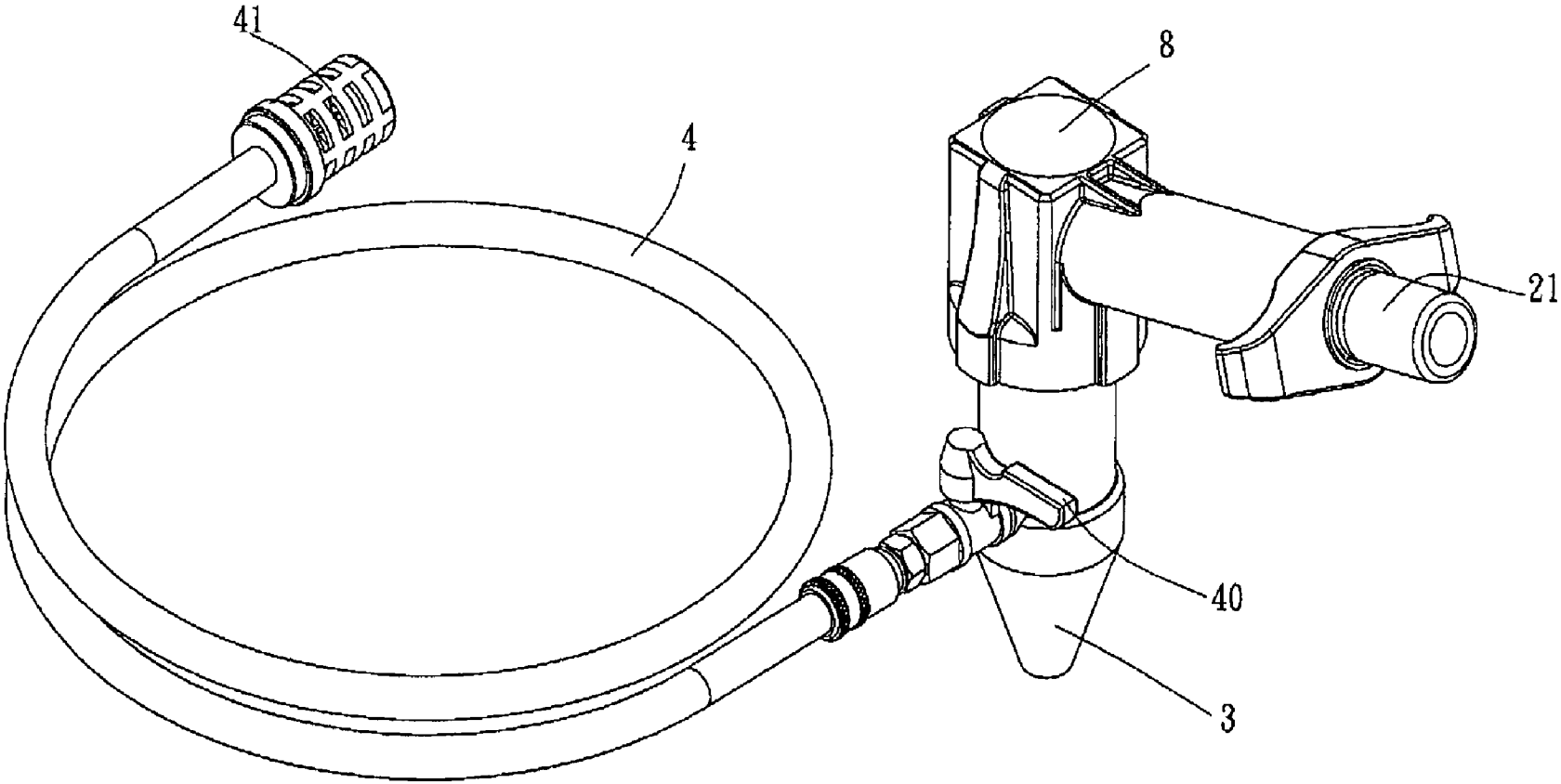
FIG. 7 is a perspective view of a second embodiment of the device made in accordance to the present invention.
Figure 8:
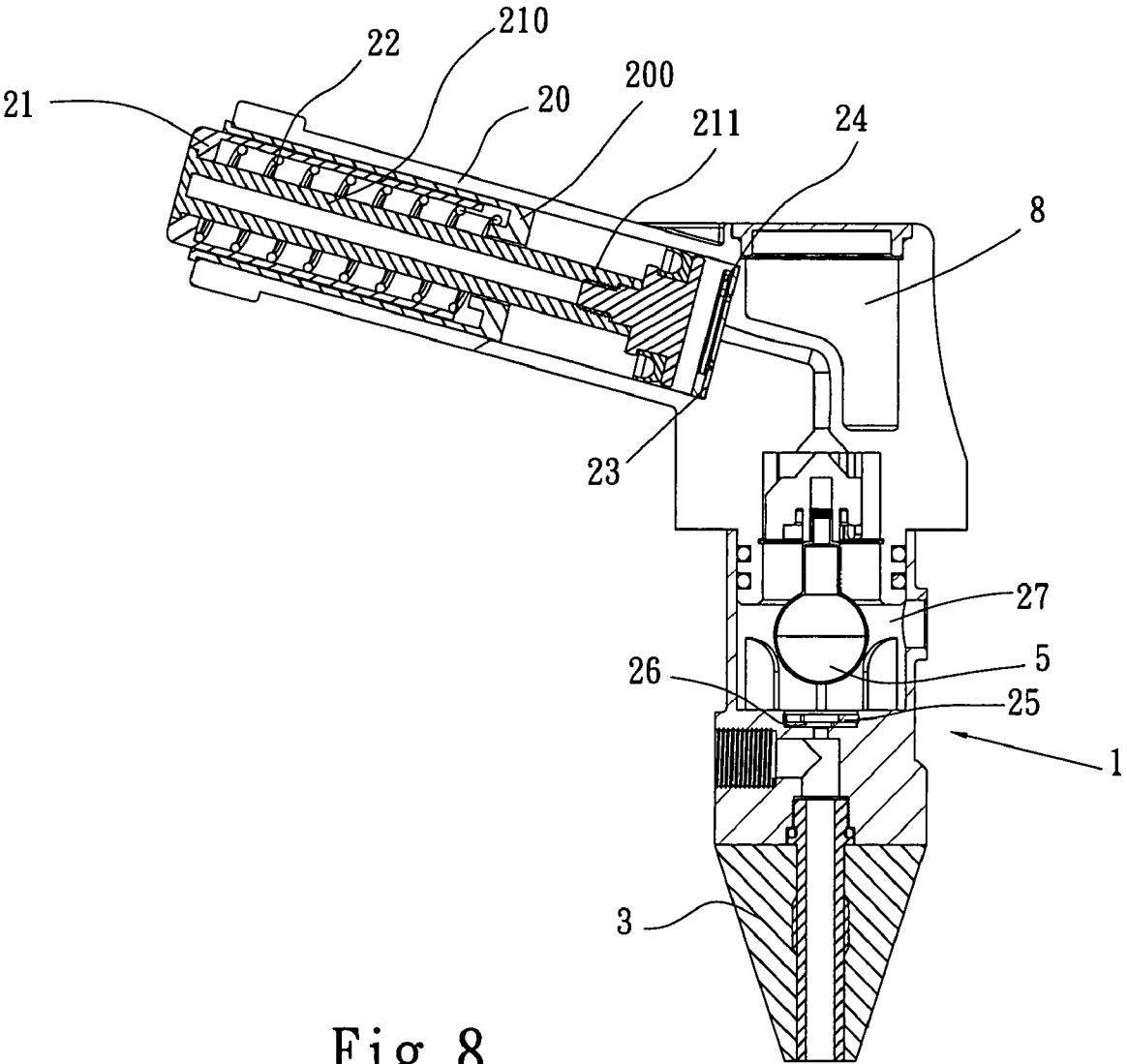
FIG. 8 is a cross sectional view of the device shown in FIG. 7.

The device made in accordance with the present invention can further be provided with an angled adapter 8 as seen in FIGS. 7 and 8 such that the pump 2 can be arranged angularly for easy operation under certain circumstance.

What is claimed is:

1. A manually operated vacuum pump and refill device, comprising:

a body including a first inlet connected with a water supply, and an adapter in communication with the first inlet with a control valve thereof;

a vacuum pump attached to the body, and including an outer pipe with a stopper therein, a piston assembly assembled within the outer pipe, and a first check valve being arranged between the vacuum pump and the body;

a second check valve being provided in the body and spaced from the first valve to define therebetween a chamber in the body to movably receive a float therein, the chamber being in communication with the first valve through a conduit defined in the body;

wherein overflow of water through the second valve into the chamber moves the float to block the conduit so as to prevent the water from entering the first valve and thus the pump.

2. The device as recited in claim 1, wherein the first check valve is securely positioned by a C-clip.

3. The device as recited in claim 1, wherein the adapter of the body is insertable into a receptacle to form an airtight seal around a periphery thereof.

4. The device as recited in claim 3, wherein the adapter of the body has a central opening with a first longitudinal axis and wherein the piston assembly reciprocates within the outer pipe along a second axis, the first axis being offset and non-coincident with the second axis.

5. A manually operated vacuum pump and refill device comprising:

a body having a first inlet, an adapter being in communication with the first inlet and having a control valve;

a water supply connected to the first inlet;

a vacuum pump attached to a top of the body, the vacuum pump including an outer pipe with a stopper therein, a piston assembly being reciprocally mounted within the outer pipe, the stopper preventing withdrawal of the piston assembly from the outer pipe, a first check valve being provided between the vacuum pump and the body;

a chamber being provided within an upper end of the body, a second check valve being provided between the chamber and the first inlet, a float being movably provided within the chamber to be between the first and second check valves, whereby the float is caused to close an opening to the first valve and prevent release of water through the piston assembly when the chamber fills with water while continuing to permit flow of water through the water supply.

6. The device as recited in claim 5, wherein a first end of the water supply is connected to the first inlet and wherein a second end of the water supply has a filter.

7. The device as recited in claim 5, wherein adapter is insertable into a receptacle to form an airtight seal around a periphery thereof.

8. The device as recited in claim 7, wherein the piston assembly can apply a vacuum to the receptacle and wherein upon opening of the control valve, water will flow into the receptacle due to a pressure differential without additional pumping of the piston assembly.

9. The device as recited in claim 5, wherein the second check valve is securely positioned by a C-clip.

10. The device as recited in claim 5, wherein the first check valve is securely positioned by a C-clip.

11. The device as recited in claim 5, wherein an angular adapter is provided between the pump and the body, the adapter of the body has a central opening with a first longitudinal axis and wherein the piston assembly reciprocates within the outer pipe along a second axis, the first axis being offset and non-coincident with the second axis.

12. The device as recited in claim 5, wherein adapter of the body has a central opening with a first longitudinal axis and wherein the piston assembly reciprocates within the outer pipe along a second axis, the first and second axes being coextensive.

* * * * *